United States Patent [19]

Kalamasz

[11] Patent Number: 4,595,473

[45] Date of Patent: Jun. 17, 1986

[54] FORGING LUBRICANT

[75] Inventor: Thomas G. Kalamasz, Mentor, Ohio

[73] Assignee: TRW Inc., Cleveland, Ohio

[21] Appl. No.: 645,089

[22] Filed: Aug. 28, 1984

[51] Int. Cl.[4] ..... C25D 13/02

[52] U.S. Cl. ..... 204/181.1; 204/181.5

[58] Field of Search ..... 204/181 N, 181 T, 181.1, 204/181.5

[56] References Cited

U.S. PATENT DOCUMENTS

| | | | |
|---|---|---|---|
| 2,734,857 | 2/1956 | Snyder | 204/181 N |
| 3,642,597 | 2/1972 | Sheldon | 204/181 N |
| 3,925,179 | 12/1975 | Yamamoto | 204/181 N |
| 4,281,528 | 8/1981 | Spiegelberg et al. | 72/46 |
| 4,318,792 | 3/1982 | Snow | 204/181 R |

*Primary Examiner*—John F. Niebling
*Assistant Examiner*—B. J. Boggs, Jr.
*Attorney, Agent, or Firm*—Calvin G. Covell; Sol L. Goldstein

[57] ABSTRACT

In order to improve the results which are obtained during the forging of a workpiece, the workpiece is electrophoretically coated with a lubricant formed of glass particles having two distinct formulations. Thus, soft glass particles having a formulation which results in transformation of the glass particles from a solid to a liquid at a relatively low temperature are interspersed with hard glass particles having a formulation which results in transformation of the glass particles from a solid to a liquid at a relatively high temperature. At the relatively high temperature, the materials of the hard and soft melted glass particles combine to form a combined glass lubricant which has a desired viscosity and lubricity at forging temperatures. This enables the soft glass particles to melt at a relatively low temperature and form an oxidation barrier around the workpiece in early stages of a preheat cycle. As the preheat cycle continues, the hard glass particles is transformed to a liquid and combine with the melted soft glass particles to provide a combined glass lubricant which has the high temperature characteristics necessary to insure that good lubrication is achieved during the forging operation.

7 Claims, 5 Drawing Figures

FORGING LUBRICANT

BACKGROUND OF THE INVENTION

The present invention relates to the forging of workpieces and more specifically to the providing of a forging lubricant which prevents oxidation during heating of a workpiece and provides good lubrication during forging of the workpiece.

It has been suggested that forging lubricants having various compositions could be applied to a workpiece by brushing, spraying, dipping in the manner disclosed in U.S. Pat. No. 4,281,528. In addition, the electrophoretic deposition of a forging lubricant onto the surface of a workpiece is disclosed in U.S. Pat. No. 4,318,792. These forging lubricants may be formed of glass and promote good surface quality, metal flow, dimensional accuracy, grain structure and mechanical properties in the forged part.

When a workpiece is to be forged, it is preheated to the forging temperature, approximately 1700° F. for titanium alloy aircraft engine components. During preheating, the glass should quickly fuse at a relatively low temperature to form a coherent uniform layer over the workpiece to prevent oxidation of the workpiece and the development of alpha case.

When the workpiece is placed in the dies, the forging lubricant should act as a thermal barrier between the workpiece and the dies to retard the transfer of heat from the workpiece to the dies with a resulting chilling of the workpiece. However, perhaps most importantly, the forging lubricant should possess sufficient viscosity at forging temperatures to enable it to act as a hydrodynamic lubricant.

The frictional restraint to metal flow during the forging process is directly proportional to the viscosity of the layer of glass lubricant. However, as viscosity is increased, the frictional restraint to metal flow increases and reduces the effectiveness of the lubricant. Therefore, excessive lubricant viscosity leads to an increase in the overall frictional factors in the forging operation.

If the viscosity of the lubricant is too low, then a very thin layer of lubricant is provided between the die and the workpiece. This thin layer of lubricant allows a plastic shearing of the forged part surfaces by the dies. In addition, if the viscosity is too low, the lubricant is squeezed out from between the workpiece and the dies. Of course, this destroys the hydrodynamic layer and prevents the lubricant from performing its intended function.

SUMMARY OF THE PRESENT INVENTION

The present invention provides an improved forging lubricant which is made up of particles of a relatively soft glass and particles of a relatively hard glass. The particles of a relatively soft glass are transformed from a solid to a liquid at a relatively low temperature and form an oxidation barrier over the workpiece. At this time, the particles of the relatively hard glass and the workpiece are enclosed by a liquid coating of material of the soft glass particles.

The melted soft glass particles have a very low viscosity and quickly form an oxidation barrier around the workpiece. However, the soft glass particles do not have sufficient thermal stabililty in order to retain the requisite lubricating characteristics for extended periods of time at relatively high temperatures (1700° F.) used during forging. In addition, the lubricant coating formed from the soft glass particles does not have the necessary viscosity to function as a hydrodynamic lubricant during forging.

As the temperature of the workpiece continues to be raised during the preheating process, the hard glass particles are transformed from a solid to a liquid and combine with the liquid of the melted soft glass particles to form a combined glass lubricant. The combined glass lubricant, as a result of the characteristics of the melted hard glass particles, is relatively stable at the elevated temperatures necessary for forging a workpiece and prevents premature burn off of the lubricant coating prior to forging. In addition, the melted hard glass particles provide the combined glass lubricant with sufficient viscosity to function as a hydrodynamic lubricant at forging temperatures. By varying the specific formulations of the hard and soft glass particles and the relative percentages of the hard and soft glass particles in the lubricant coating, the viscosity of the combined glass lubricant can be adjusted over a wide range to obtain a lubricant which is capable of meeting a given set of requirements for the forging of a particular workpiece.

The hard and soft glass particles are deposited on the workpiece, prior to preheating, by an electrophoretic coating process. In this process, hard and soft glass particles of a selected formulation and quantity are intermixed and then suspended in an electrophoretic bath. The workpiece is immersed in the electrophoretic bath and an anodic potential is applied to the workpiece while cathodic potential is applied to a cathode. This results in the electrophoretic deposition on the workpiece of a coating in which the soft and hard glass particles are interspersed with each other and are evenly dispersed over the outside of the workpiece.

Accordingly, it is an object of this invention to provide a new and improved forging lubricant coating which is electrophoretically deposited on a workpiece and includes soft glass particles which melt at a relatively low temperature to form an oxidation barrier over the outside of the workpiece and hard particles which melt at a relatively high temperature and combine with the melted soft glass particles to form a combined glass lubricant.

BRIEF DESCRIPTION OF THE DRAWINGS

The foregoing and other objects and features of the present invention will become more apparent upon a consideration of the following disclosure taken in connection with the accompanying drawings wherein.

DESCRIPTION OF ONE SPECIFIC PREFERRED EMBODIMENT OF THE INVENTION

General Description

Figure 1:
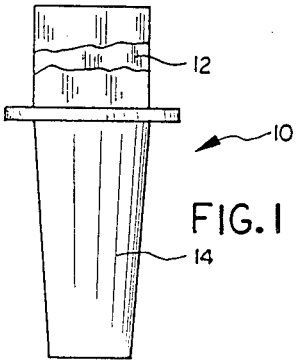
FIG. 1 is a schematic illustration of a workpiece which is covered with a lubricant coating containing particles of a soft glass and particles of a hard glass.

A partially shaped workpiece 10 to be hot forged is illustrated schematically in FIG. 1. The workpiece 10 is formed of a titanium alloy and is to be hot forged to form a blade for use in an aircraft engine. In order to obtain the desired forging quality, an outer side surface 12 of the workpiece is completely enclosed by a covering 14 of forging lubricant. The covering 14 of forging lubricant was electrophoretically deposited on the workpiece 10 with the cell 18 of FIG. 2.

Figure 3:
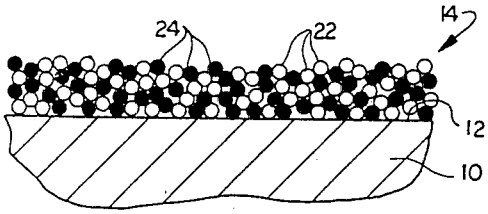
FIG. 3 is an enlarged schematic illustration of a portion of the coating which is electrophoretically deposited on the workpiece of FIG. 1 and illustrating the manner in which hard and soft glass particles are interspersed over the surface of the workpiece.

In accordance with a feature of the present invention, the covering 14 of forging lubricant is made up of glass particles having two distinct formulations. Thus, the lubricant covering 14 includes soft glass particles 22, which have been schematically indicated by lack of shading in FIG. 3, and hard glass particles 24, which have been schematically indicated by being shaded in FIG. 3.

Figure 4:
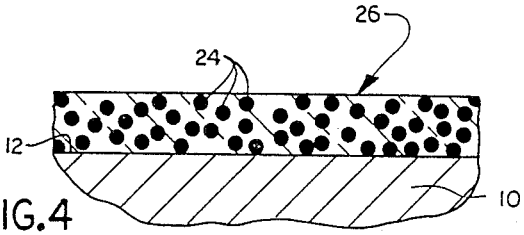
FIG. 4 is a schematic illustration, generally similar to FIG. 3, of the lubricant coating after the workpiece has been heated to a temperature sufficient to cause the transformation of the soft glass particle to a liquid.

During preheating of the workpiece, the soft glass particles 22 transform from a solid to a liquid at a relatively low temperature to form a coating 26 (FIG. 4) over the entire outer side surface 12 of the workpiece. The melted soft glass particles have a relatively low viscosity and quickly form a coating 26 over the entire surface of the airfoil during the early stages of the preheating cycle. The coating 26 acts as an oxidation barrier to reduce the chances for the development of alpha case. It should be noted that the hard glass particles 24 have not yet transformed from a solid into a liquid and are enclosed by the coating 26 along with the surface 12 of the workpiece.

Figure 5:
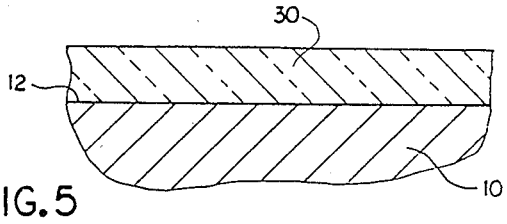
FIG. 5 is a fragmentary sectional view, generally similar to FIGS. 3 and 4, illustrating the manner in which a combined glass lubricant coating covers the surface of the workpiece after it has been heated to a temperature sufficient to transform the hard glass particles from a solid to a liquid.

As the preheating cycle continues and the temperature of the workpiece 10 increases, the hard glass particles 24 transform from a solid to a liquid. Upon melting of the hard glass particles 24, the material in these particles combines with the material from the previously melted soft glass particles 22 to form a combined glass lubricant 30 (FIG. 5). The specific formulation of the hard and soft glass particles 22 and 24 and the amount of hard glass particles relative to the amount of the soft glass particles is selected so that the combined glass lubricant 30 has the desired viscosity at forging temperatures.

Electrophoretic Deposition Of Forging Lubricant

Figure 2:
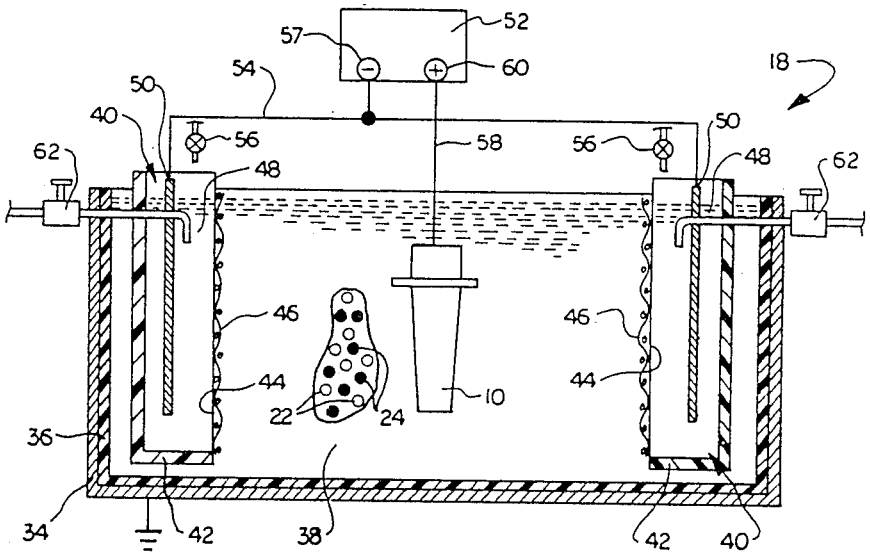
FIG. 2 is a schematic illustration of an apparatus which is used to electrophoretically deposit the lubricant coating over the workpiece of FIG. 1.

The covering 14 of forging lubricant is electrophoretically deposited on the workpiece 10 in the cell 18 of FIG. 2. The cell 18 generally comprises a tank 34 having an inert lining 36 on its interior surface.

The tank 34 is filled with an aqueous coating bath 38 containing suspended soft glass particles 22 and hard glass particles 24. Although the hard and soft glass particles 22 and 24 are evenly dispersed throughout the bath 38, only a portion of the glass particles has been indicated schematically in FIG. 2. In order to obtain a uniform coating 14 with an even interspersion of the hard and soft glass particles 22 and 24, it has been determined that the specific resistivity of the bath 38 should be greater than 1000 ohm centimeters.

The cell 18 includes a pair of cathode compartments 40 which include an open-sided box 42 having a dialysis or ion exchange membrane 44 forming one side of a compartment. A reinforcing mesh 46 is provided adjacent to the membrane 44 to protect the membrane from impact. The cathode compartments 40 are preferably filled with a non-ionic liquid such as de-ionized water 48. An electrophoresis cathode 50 is immersed in the de-ionized water 48 within each of the cathode compartments 40.

The workpiece 10 is immersed in the coating bath 38 and is positioned centrally between the cathode 50. A direct current power source 52 is provided and the cathodes are connected through a cathode bus 54 to the negative pole 56 of the power source 52. In a similar manner, the workpiece 10 is connected through an anode bus 58 to the positive pole 60 of the power source 52.

Upon application of a potential difference between the electrophoresis cathode 50 and the workpiece 10, charged species within the coating bath 38 migrate within the bath. The applied voltage is in the range of 20–40 volts DC with current densities of 5 amp/sq.ft. to 50 amp/sq.ft. The negatively charged species, such as negative ions in solution and, more importantly, negatively charged soft glass particles 22 and hard glass particles 24, which have been illustrated schematically in FIG. 2 in a portion of the bath, are transported to and deposited on the workpiece 10. In a similar manner, the positive ions, particularly alkali metal ions, in solution in the coating bath 38, migrate through the membrane 44 into the cathode compartments 40.

Hydrogen gas is evolved at the cathodes and the alakalinity of the water 48 in the cathode compartments increases. The evolved hydrogen gas may be collected and/or vented as appropriate.

In order to maintain a high resistivity in the water 48 within the cathode compartments 40, a portion of the alkaline solution in the cathode compartments 40 is periodically or continuously withdrawn through taps 62. In order to replace the volume of solution withdrawn from the cathode compartments 40, taps 56 are provided for adding de-ionized water to the cathode compartments. The action of the membrane 44 and the cationic transport of alkali metal ions therethrough to the cathode compartments 40 is effective to maintain the specific resistivity of the bath 38 above the desired 1000 ohm-centimeter level during the coating deposition process.

The soft and hard glass particles 22 and 24 are preferably maintained in suspension in the bath 38 through the use of agitation. Thus, a mechanical agitator such as a propeller stirer (not shown) may be provided to agitate the bath 38. It will be understood, however, that other agitation may be provided. The general construction and mode of operation of the cell 18 is the same as is described in U.S. Pat. No. 4,318,792 and will not be further described herein in order to avoid prolixity of description.

Composition of Glass Particles

The soft glass particles 22 have a composition which allows them to melt early in the preheat cycle to form an oxidation barrier. The melted soft glass particles 22 have a relatively low viscosity so that the coating 26 (FIG. 4) is quickly formed over the outside surface 12 of the workpiece 10. Thus, during a preheating cycle, the workpiece is normally heated up to a temperature of approximately 1700° F. The soft glass particles 22 transform from a solid to a liquid when the particles have been heated to a temperature of approximately 1000° F.

The coating 26 formed by the melted soft glass particles 22 acts as an oxidation barrier during the remainder of the preheat cycle. To provide for the relatively low temperature transformation of the soft glass particles, they have the following composition:

| Component | % Composition Based On Weight of The Fused Glass Particles |
|---|---|
| $SiO_2$ | 20.0 |
| $B_2O_3$ | 12.0 |
| PbO | 56.0 |
| ZnO | 6.0 |
| CaO | 5.6 |
| $V_2O_5$ | .5 |

The amount of silica ($SiO_2$) is relatively low and there is no alumina ($Al_2O_3$) in the soft glass particles. This results in the soft glass particles having a relatively low transition temperature. Therefore, the soft glass particles 22 will have completely melted when the workpiece 10 is preheated to a temperature of approximately 1000° F.

As the preheating cycle continues, the temperature of the workpiece 10 rises. When the workpiece 10 has been heated to a temperature of approximately 1300° F., the hard glass particles 24 will have transformed from the solid state to the liquid state. The hard glass particles 24 have the following composition:

| Component | % Composition Based On Weight of The Fused Glass Particles |
|---|---|
| $SiO_2$ | 29.9 |
| $B_2O_3$ | 8.0 |
| $Al_2O_3$ | 5.8 |
| PbO | 41.2 |
| ZnO | 6.0 |
| MgO | 3.0 |
| CaO | 5.6 |
| $V_2O_5$ | .5 |

The hard glass particles 24 contain a relatively high percentage of silica and a substantial percentage of alumina. This results in the hard glass particles melting when the temperature of the workpiece is raised to approximately 1300° F. during the preheat cycle.

The melted hard and soft glass particles combine to form the combined glass lubricant 30. The characteristics of the combined glass lubricant 26 will depend upon the specific formulation of the hard and soft glass particles 22 and 24 and upon the relative amounts of hard and soft glass particles.

Although a specific formulation for the hard and soft glass particles 22 and 24 have been set forth herein, it is contemplated that the formulation for the hard and soft glass particles 22 and 24 could be varied in order to obtain the desired lubrication characteristics during forging. Thus, the amount of silica or alumina in the hard glass particles could be either increased or decreased to vary the viscosity of the combined glass lubricant at forging temperatures. The lubricating characteristics of the combined glass lubricant 30 could also be varied by varying the ratio of the quantity of soft glass particles 22 to the quantity of hard glass particles 24. Thus, increasing the quantity of hard glass particles 24 would increase the viscosity of the combined glass lubricant 30. However, for the forging of certain workpieces, it has been found that the lubricant coating or covering 14 advantageously contains 50%–60% soft glass particles 22 and 50%–40% hard glass particles 24 having the specific compositions previously set forth herein.

Conclusion

In view of the foregoing description it is apparent that the present invention provides an improved forging lubricant 14 which is made up of particles 22 of a relatively soft glass and particles 24 of a relatively hard glass. The particles 22 of a relatively soft glass are transformed from a solid to a liquid at a relatively low temperature and form an oxidation barrier over the workpiece 10. At this time, the particles 24 of the relatively hard glass and the workpiece 10 are enclosed by a liquid coating 26 of material of the soft glass particles.

The melted soft glass particles 22 have a very low viscosity and quickly form an oxidation barrier 26 around the workpiece 10. However, the soft glass particles 22 do not have sufficient thermal stabililty in order to retain the requisite lubricating characteristics for extended periods of time at relatively high temperatures (1700° F.) used during forging. In addition, the lubricant coating 26 formed from the soft glass particles 20 does not have the necessary viscosity to function as a hydrodynamic lubricant during forging.

As the temperature of the workpiece 10 continues to be raised during the preheating process, the hard glass particles 24 are transformed from a solid to a liquid and combine with the liquid of the melted soft glass particles to form a combined glass lubricant 30. The combined glass lubricant 30, as a result of the characteristics of the melted hard glass particles 24, is relatively stable at the elevated temperatures necessary for forging a workpiece and prevents premature burn off of the lubricant coating 30 prior to forging. In addition, the melted hard glass particles 24 provide the combined glass lubricant 30 with sufficient viscosity to function as a hydrodynamic lubricant at forging temperatures. By varying the specific formulations of the hard and soft glass particles 22 and 24 and the relative percentages of the hard and soft glass particles in the lubricant coating 30, the viscosity of the combined glass lubricant can be adjusted over a wide range to obtain a lubricant which is capable of meeting a given set of requirements for the forging of a particular workpiece.

The hard and soft glass particles 22 and 24 are deposited on the workpiece 10, prior to preheating, by an electrophoretic coating process. In this process, the hard and soft glass particles 22 and 24 of a selected formulation and quantity are intermixed and then evenly suspended in an electrophoretic bath 38. The workpiece 10 is immersed in the electrophoretic bath 38 and an anodic potential is applied to the workpiece 10 while cathodic potential is applied to cathodes 50. This results in the electrophoretic deposition on the workpiece 10 of a coating 14 in which the soft and hard glass particles 22 and 24 are interspersed with each other and are evenly dispersed over the outside of the workpiece 10.

Having described one specific preferred embodiment of the invention, the following is claimed:

1. A method comprising the steps of electrophoretically coating a workpiece with first glass particles which transform from a solid to a liquid at a first temperature and second glass particles which transform from a solid to a liquid at a second temperature which is higher than the first temperature, heating the coated workpiece, to a first temperature, forming a non-lubricative oxidation barrier over the outside of the workpiece at said first temperature that is below said second temperature by transforming the first glass particles to a liquid at said first temperature while said second glass particles remain in solid form, continuing the heating of the workpiece to said second temperature and transforming the second glass particles from a solid to a liquid at the second temperature said first and second glass particles being combined at said second temperature to form a glass lubricant having a viscosity distinct from the viscosities of either of said first or second glass compositions and sufficient to function as a hydrodynamic lubricant on forging the workpiece while it is covered with the combined glass lubricant.

2. A method as set forth in claim 1 wherein said step of electrophoretically coating a workpiece includes the steps of providing a bath containing the first and second glass particles, at least partially immersing the workpiece in the bath, and electrophoretically depositing the first and second glass particles on the workpiece.

3. A method as set forth in claim 2 wherein said step of electrophoretically depositing the first and second glass particles on the workpiece includes the step of applying anodic potential to the workpiece while maintaining the specific resistivity of the bath at a level in excess of 1,000 ohm-centimeter.

4. A method as set forth in claim 1 wherein said step of electrophoretically coating a workpiece includes providing first glass particles containing a first amount of silica ($SiO_2$) and second glass particles containing a second amount of silica, said second amount of silica being greater than said first amount of silica, forming a bath containing the first and second glass particles, at least partially immersing the workpiece in the bath, at least partially immersing a cathode in the bath, and applying anodic potential to the workpiece while applying cathodic potential to the cathode to electrophoretically deposit a coating containing the first and second glass particles on the workpiece.

5. A method as set forth in claim 1 wherein said step of electrophoretically coating a workpiece includes providing first glass particles containing a first amount of alumina ($Al_2O_3$) and second glass particles containing a second amount of alumina, said second amount of alumina being greater than said first amount of alumina, forming a bath containing the first and second glass particles, at least partially immersing the workpiece in the bath, at least partially immersing a cathode in the bath, and applying anodic potential to the workpiece while applying cathodic potential to the cathode to electrophoretically deposit a coating containing the first and second glass particles on the workpiece.

6. A method as set forth in claim 1 wherein said step of electrophoretically coating the workpiece includes electrophoretically depositing a coating of the first and second glass particles on the workpiece with the first and second glass particles interspersed with each other and substantially evenly dispersed over the outside of the workpiece.

7. A method as set forth in claim 1 wherein said step of forming an oxidation barrier over the workpiece includes providing a liquid coating of the melted first glass particles over the entire surface of the workpiece and around the second glass particles while the second glass particles are in a solid state.

* * * * *